US011230868B2

(12) United States Patent
Dennis

(10) Patent No.: US 11,230,868 B2
(45) Date of Patent: Jan. 25, 2022

(54) TORQUE ROD FOR CLOSURE PANEL OF VEHICLE

(71) Applicant: Nissan North America, Inc., Franklin, TN (US)

(72) Inventor: Thomas Scott Dennis, Phoenix, AZ (US)

(73) Assignee: NISSAN NORTH AMERICA, INC., Franklin, TN (US)

( * ) Notice: Subject to any disclaimer, the term of this patent is extended or adjusted under 35 U.S.C. 154(b) by 252 days.

(21) Appl. No.: 16/667,316

(22) Filed: Oct. 29, 2019

(65) Prior Publication Data

US 2021/0123281 A1 Apr. 29, 2021

(51) Int. Cl.

| | |
|---|---|
| ***E05F 1/12*** | (2006.01) |
| ***E05F 1/10*** | (2006.01) |
| *E05D 5/06* | (2006.01) |

(52) U.S. Cl.

CPC ..... *E05F 1/1238* (2013.01); *E05F 1/1033* (2013.01); *E05D 2005/067* (2013.01); *E05Y 2900/548* (2013.01)

(58) Field of Classification Search

CPC ..... E05F 1/123; E05F 1/1238; E05F 1/1033; E05F 1/1215; E05F 1/1016; E05D 2005/067; F03G 1/02; F03G 1/08

USPC ..... 296/76; 267/154, 155; 49/386

See application file for complete search history.

(56) References Cited

U.S. PATENT DOCUMENTS 1,859,563 A * 5/1932 Hobert ..... E05C 17/32 296/76
2,150,435 A * 3/1939 Floreth ..... E05F 1/1016 16/76
2,894,277 A * 7/1959 Bogater ..... E05F 1/1238 16/298
2,986,770 A * 6/1961 Hammond ..... E05F 1/1238 16/308
3,024,488 A * 3/1962 Germann ..... E05F 1/1215 16/306
3,469,277 A * 9/1969 Brown ..... E05D 5/06 16/324
3,476,375 A * 11/1969 Brasseur ..... E05F 1/1238 267/277
4,199,177 A * 4/1980 Danzer ..... E05B 83/16 292/144
4,291,501 A * 9/1981 Steinberg ..... E05F 1/1238 16/308
4,458,379 A * 7/1984 Shelton ..... E05D 11/1014 16/297
5,365,639 A * 11/1994 Lewkoski ..... E05D 7/0423 16/224

(Continued)

*Primary Examiner* — Jeffrey O'Brien
(74) *Attorney, Agent, or Firm* — Global IP Counselors, LLP

(57) ABSTRACT

A torque rod for a closure panel of a vehicle includes a first end portion, a second end portion, a fixing portion, and first and second coiled spring portions. The first end portion is configured to be connected to a first hinge member connected to the closure panel. The second end portion is configured to be connected to a second hinge member connected to the closure panel. The fixing portion is configured to be fixed to the vehicle body structure. A first coiled spring portion is disposed between the first end portion and the fixing portion. A second coiled spring portion is disposed between the second end portion and the fixing portion.

18 Claims, 5 Drawing Sheets

(56) References Cited

U.S. PATENT DOCUMENTS 5,584,099 A * 12/1996 Westerdale ..... E05D 5/062 16/235
5,730,239 A * 3/1998 Holter ..... B62D 25/12 180/69.21
5,746,468 A * 5/1998 Schoen ..... E05F 1/1033 16/298
5,758,389 A * 6/1998 Wolda ..... E05F 1/1238 16/302
5,771,540 A * 6/1998 Carpenter ..... G06F 1/1616 16/299
5,873,619 A * 2/1999 Lewkoski ..... E05D 7/0423 296/76
6,419,293 B1 * 7/2002 Nicholas ..... E05F 1/1033 296/76
6,568,033 B2 * 5/2003 Kim ..... E05F 1/1033 16/334
6,619,723 B2 * 9/2003 Duffy ..... B60P 3/39 16/290
7,156,450 B2 * 1/2007 McIntyre ..... E05F 1/1238 16/308
7,469,953 B2 * 12/2008 Heath ..... E05D 5/062 16/289
7,730,584 B2 * 6/2010 Duffy ..... E05F 1/1215 16/304
8,251,431 B2 * 8/2012 Nakazato ..... E05F 1/1033 296/76
8,414,058 B2 * 4/2013 Duffy ..... E05D 5/062 296/76
8,469,433 B2 * 6/2013 Krajenke ..... E05F 1/1238 296/76
8,540,305 B2 * 9/2013 Schulte ..... E05F 1/1238 296/183.1
8,978,203 B2 * 3/2015 Krajenke ..... E05F 5/06 16/86 R
9,217,267 B2 * 12/2015 Duffy ..... E05D 3/02
9,476,237 B2 * 10/2016 Sato ..... E05F 1/1033
10,246,920 B2 * 4/2019 Sytek ..... F03G 1/08
10,907,391 B2 * 2/2021 Lee ..... E05F 1/1238
2008/0098567 A1 * 5/2008 Duffy ..... E05F 1/1016 16/306

* cited by examiner

TORQUE ROD FOR CLOSURE PANEL OF VEHICLE

BACKGROUND

Field of the Invention

The present invention generally relates to a torque rod for a closure panel of a vehicle. More specifically, the present invention relates to a torque rod for a closure panel of a vehicle in which the torque rod has two coiled spring portions.

Background Information

Typical closure panels, such as a trunk, for a vehicle use two torque rods to facilitate opening and closing the closure panel. The two torque rods often contact each other, thereby generating unwanted noise and wear on the torque rods. The wear deteriorates the opening and closing performance of the torque rods.

SUMMARY

An object of the disclosure is to provide a torque rod for a closure panel of a vehicle.

In view of the state of the known technology, one aspect of the present disclosure is to provide a torque rod for a closure panel of a vehicle including a first end portion, a second end portion, a fixing portion, and first and second coiled spring portions. The first end portion is configured to be connected to a first hinge member connected to the closure panel. The second end portion is configured to be connected to a second hinge member connected to the closure panel. The fixing portion is configured to be fixed to the vehicle body structure. The first coiled spring portion is disposed between the first end portion and the fixing portion. The second coiled spring portion is disposed between the second end portion and the fixing portion.

Another aspect of the present invention includes a closure panel assembly for a vehicle including a closure panel movable between a closed position and an opened position. First and second hinge members movably connect the closure panel to the vehicle. A torque rod is connected to the first and second hinge members to facilitate moving the closure panel between the closed and opened positions. The torque rod includes a first end portion connected to the first hinge member. A second end portion is connected to the second hinge member. A fixing portion engages a vehicle body structure. A first coiled spring portion is disposed between the first end portion and the fixing portion. A second coiled spring portion is disposed between the second end portion and the fixing portion.

Also other objects, features, aspects and advantages of the disclosed torque rod for a closure panel of a vehicle will become apparent to those skilled in the art from the following detailed description, which, taken in conjunction with the annexed drawings, discloses exemplary embodiments of the torque rod for a closure panel of a vehicle.

BRIEF DESCRIPTION OF THE DRAWINGS

Referring now to the attached drawings which form a part of this original disclosure.

DETAILED DESCRIPTION OF EXEMPLARY EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Referring initially to FIGS. 1-4, closure panel assembly 8 is illustrated in accordance with an exemplary embodiment of the present invention. The closure panel assembly 8 includes a torque rod 10 that facilitates opening and closing a closure panel 12 of a vehicle.

Figure 1:
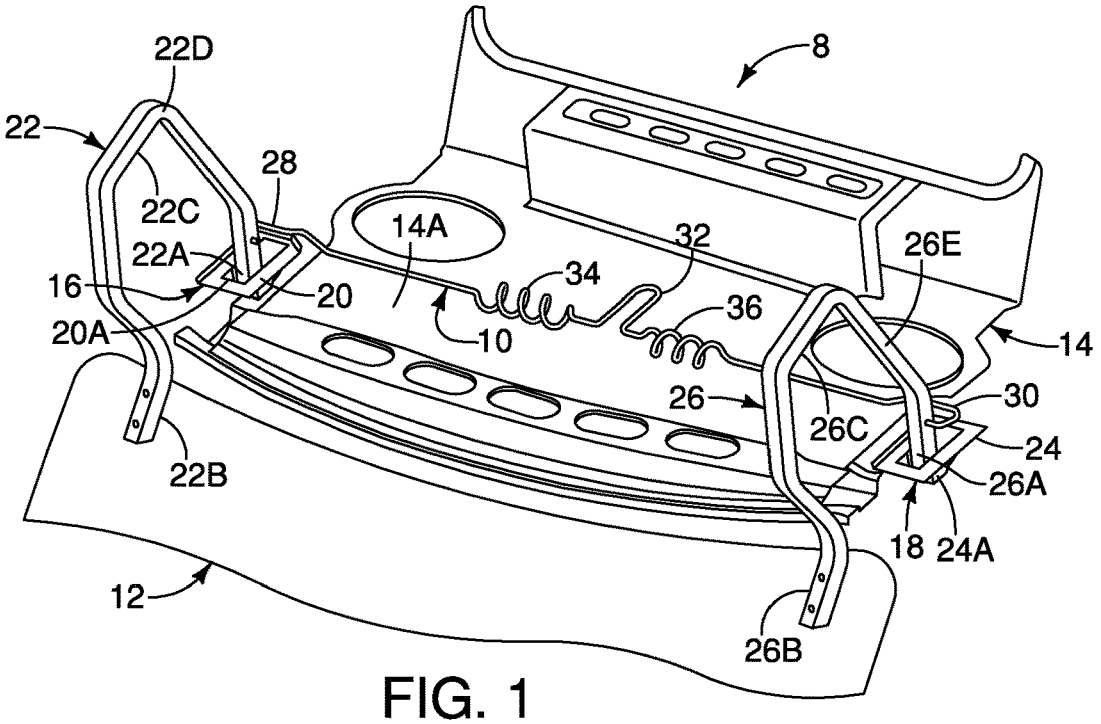
FIG. 1 is a lower perspective view of a torque rod for a closure panel of a vehicle in accordance with an exemplary embodiment of the present invention.
Figure 2:
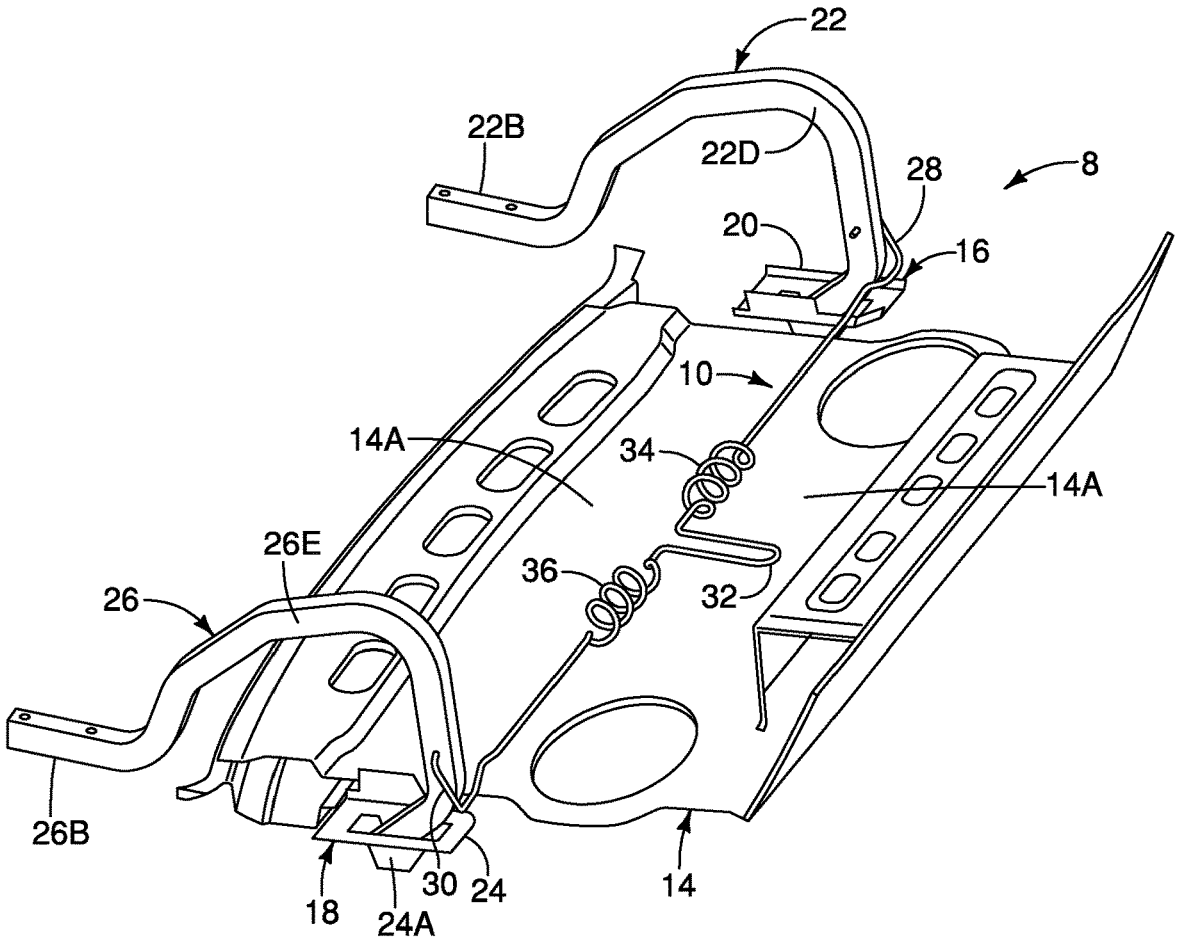
FIG. 2 is a side perspective view of the closure panel of FIG. 1.

Referring initially to FIGS. 1 and 2, the vehicle includes a rear opening to access a rear cargo space. The rear opening exposes the rear cargo space with the closure panel 12 in an open position (FIG. 1), and covers the rear cargo space in a closed position (FIG. 2) to prevent access to the rear cargo space. Because closure panels, such as a trunk lid, and rear cargo areas of vehicles are well known, further description thereof is omitted for the sake of brevity. The torque rod 10 of the present invention can be used with any suitable closure panel, such as a trunk lid, of any suitable vehicle, such as a sedan.

A shelf 14, such as a package shelf, of a vehicle body structure of the vehicle is disposed in the rear cargo space, as shown in FIGS. 1-4. The shelf 14 includes a lower surface 14A and an oppositely disposed upper surface 14B. The lower surface 14A of the shelf 14 faces the rear cargo space of the vehicle.

A first hinge member 16 and a second hinge member 18 are connected to the shelf 14, as shown in FIGS. 1-4. The first and second hinge members 16 and 18 are connected to the closure panel 12 to facilitate moving the closure panel 12 between closed and open positions. The first and second hinge members 16 and 18 are laterally spaced from one another on opposite lateral sides of the shelf 14.

The first hinge member 16 includes a first bracket 20 and a first hinge arm 22. The first bracket 20 is fixedly mounted to the shelf 14. The first hinge arm 22 is pivotally connected to the first bracket 20.

The first bracket 20 has a first recessed portion 20A that faces the rear cargo space. In other words, the first recessed portion 20A faces downwardly. The first recessed portion 20A extends in a direction away from the lower surface 14A of the shelf 14.

The first hinge arm 22 has a first end 22A and a second end 22B with a curved, or gooseneck, portion 22C formed therebetween. The first end 22A is received by the first recessed portion 20A of the first bracket 20. The first end 22A is pivotally connected to the first bracket 20 in any suitable manner to allow for pivotal movement of the first hinge arm 22 with respect to the shelf 14. The second end 22B of the first hinge arm 22 is substantially linear and has a plurality of fastener openings to facilitate connecting to the closure panel 12.

The second hinge member 18 includes a second bracket 22 and a second hinge arm 24. The second bracket 22 is fixedly mounted to the shelf 14. The second hinge arm 24 is pivotally connected to the second bracket 22. The second hinge member 18 is substantially identical to the first hinge member 16.

The second bracket 24 has a second recessed portion 24A that faces the rear cargo space. In other words, the second recessed portion 24A faces downwardly. The second recessed portion 24A extends in a direction away from the lower surface 14A of the shelf 14.

The second hinge arm 26 has a first end 26A and a second end 26B with a curved, or gooseneck, portion 26C formed therebetween. The first end 26A is received by the second recessed portion 24A of the second bracket 24. The first end 26A is pivotally connected to the second bracket 24 in any suitable manner to allow for pivotal movement of the second hinge arm 26 with respect to the shelf 14. The second end 26B of the second hinge arm 26 is substantially linear and has a plurality of fastener openings to facilitate connecting to the closure panel 12. Movement of the closure panel 12 between the closed and open positions causes the first and second hinge arms 22 and 26 to move together.

Figure 3:
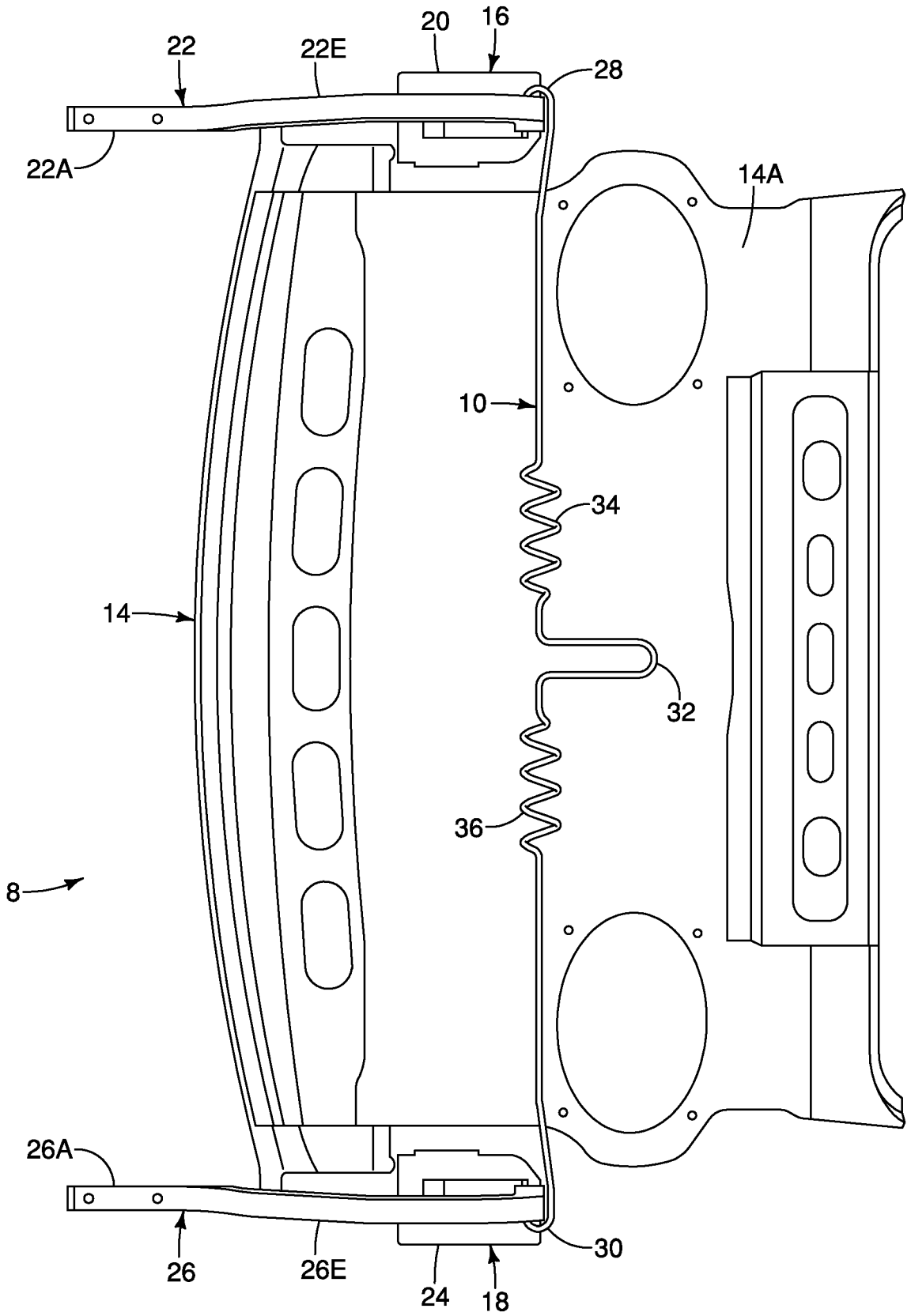
FIG. 3 is a bottom plan view of the closure panel of FIG. 1.
Figure 4:
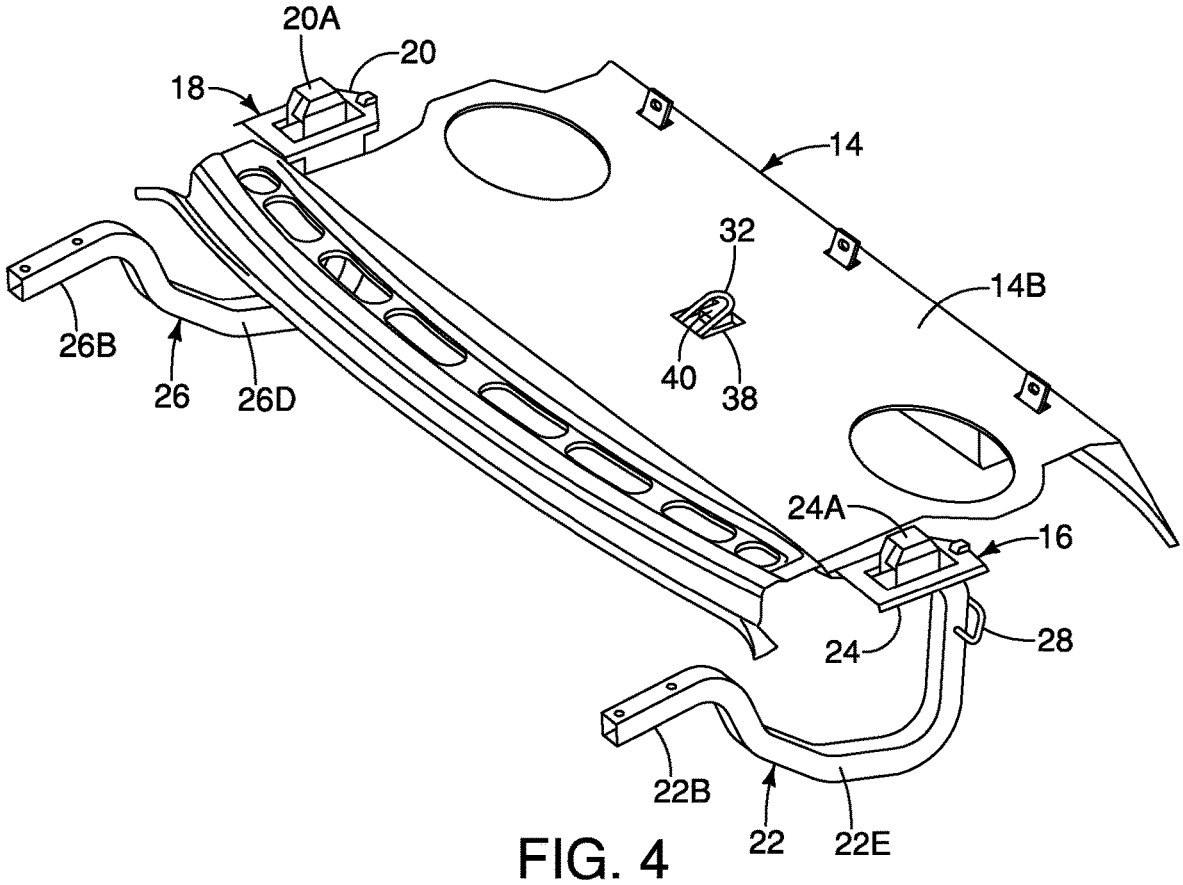
FIG. 4 is an upper perspective view of the closure panel of FIG. 1.
Figure 5:
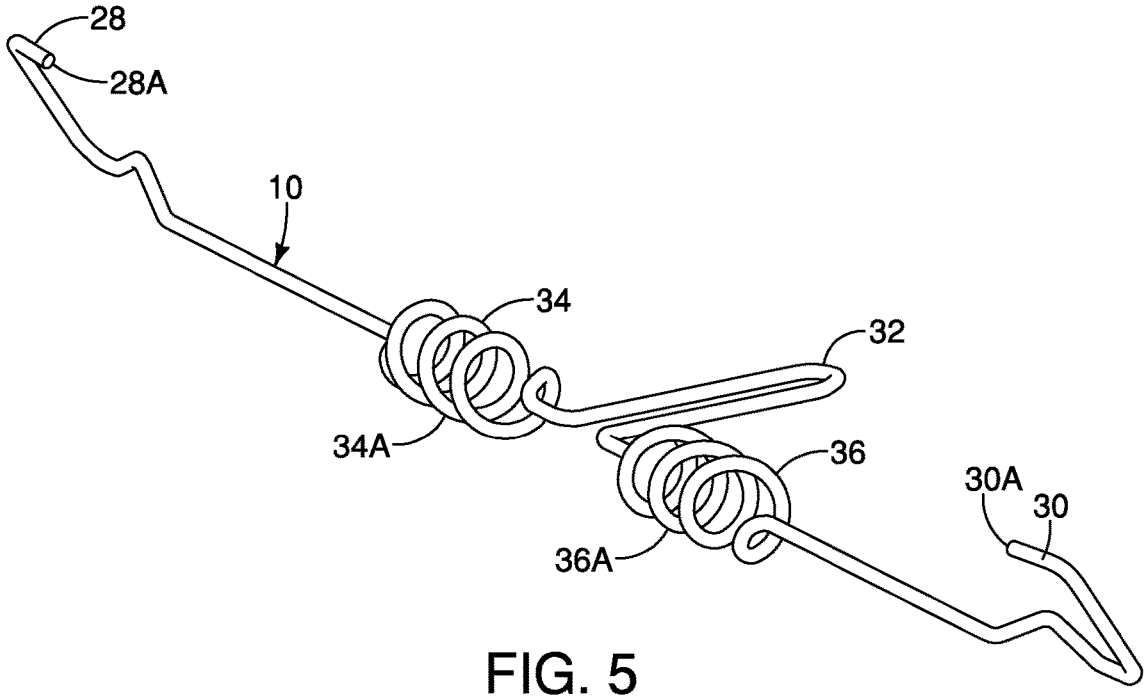
FIG. 5 is a perspective view of the torque rod of FIG. 1.
Figure 6:
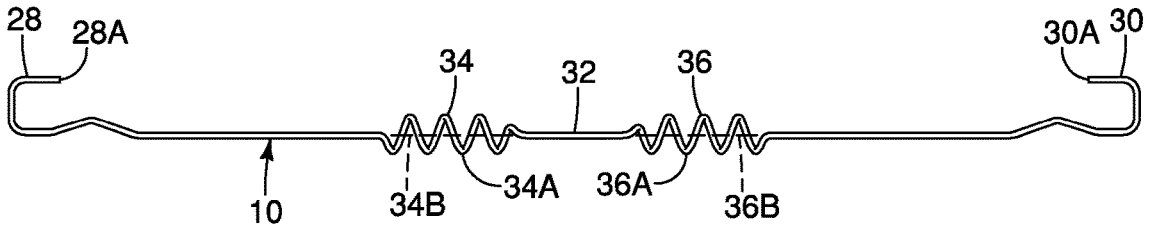
FIG. 6 is a front elevational view of the torque rod of FIG. 5.
Figure 7:
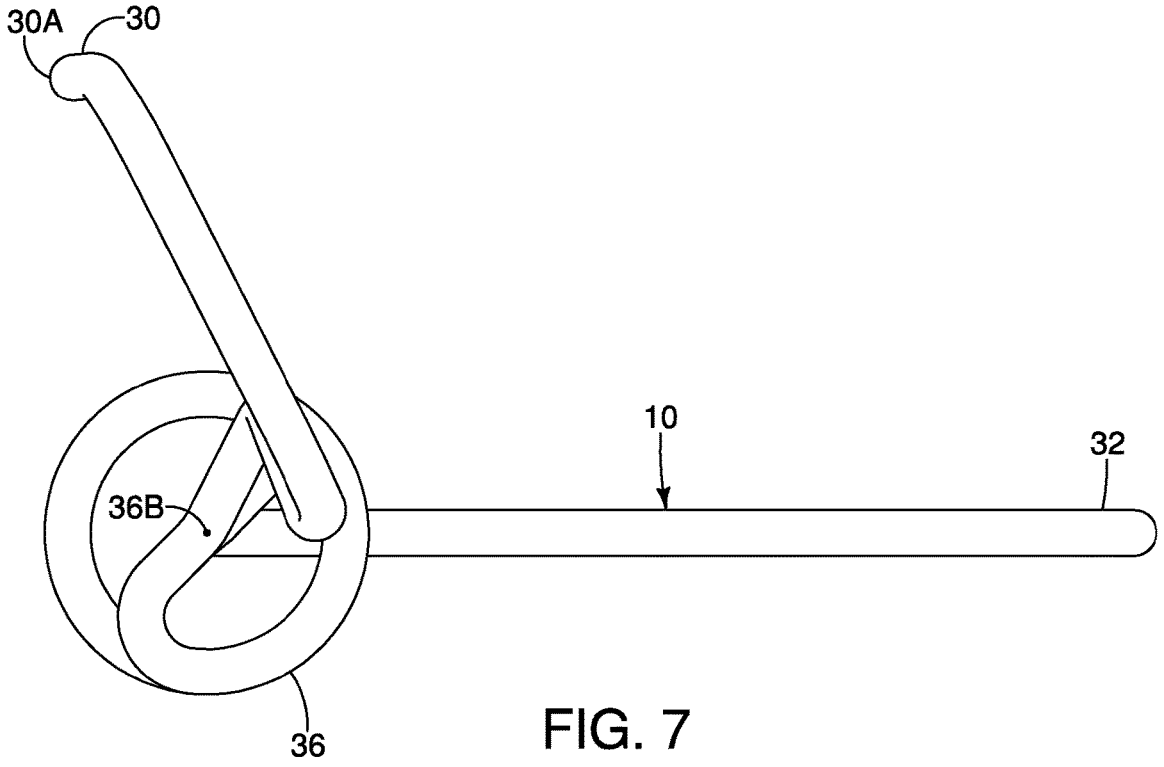
FIG. 7 is a side elevational view of the torque rod of FIG. 5.

The torque rod 10 is connected to the first and second hinge arms 22 and 26 of the first and second hinge members 16 and 18, as shown in FIGS. 1-4, to facilitate moving the closure panel 12 between the closed and open positions. As shown in FIGS. 1-4, only one torque rod 10 extends between the first and second hinge members 16 and 18. The torque rod 10 includes a first end portion 28, a second end portion 30, a fixing portion 32, a first coiled portion 34 and a second coiled portion 36, as shown in FIGS. 5-7. The torque rod 10 is preferably unitarily formed as a one-piece member, although the torque rod can be formed in multiple pieces that are connected by a suitable method, such as welding. The torque rod 10 is preferably made of a heat-treated metallic material, such as a spring-grade steel. Heat treating the material increases the durability of the torque rod 10.

The first end portion 28 is configured to be connected to the first hinge member 16. The first end portion 28 is substantially U-shaped such that the first end portion 28 passes through a torque rod opening from an outboard side 22E to an inboard side 22D, as shown in FIGS. 1-3.

The second end portion 30 is configured to be connected to the second hinge member 18. The second end portion 30 is substantially U-shaped such that the second end portion 30 passes through a torque rod opening from an outboard side 26E to an inboard side 26D, as shown in FIGS. 1-3.

Figure 9:
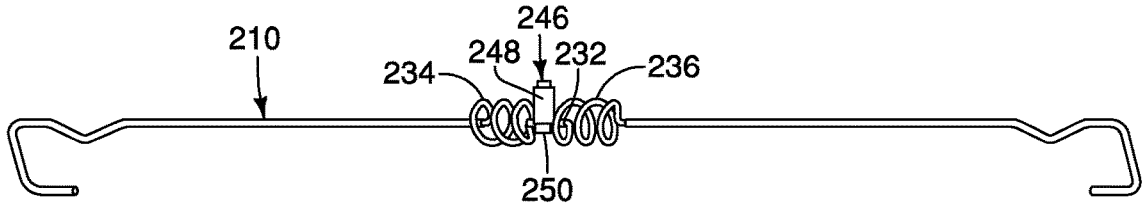
FIG. 9 is a front elevational view of a torque rod in accordance with another exemplary embodiment of the present invention.
Figure 10:
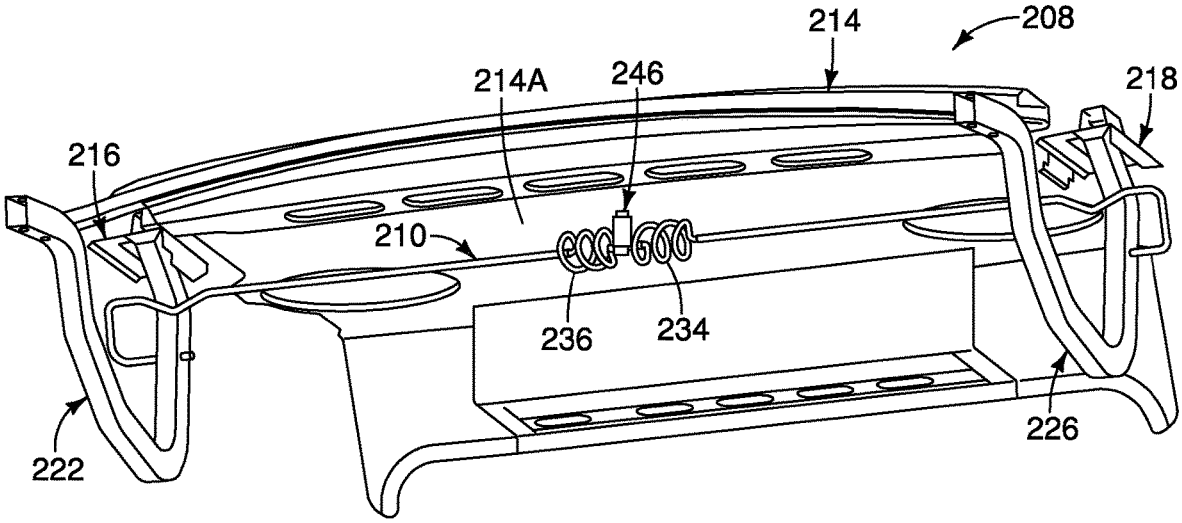
FIG. 10 is a perspective view of the torque rod of FIG. 9 connected to a package shelf of a vehicle.

A fixing portion 32 of the torque rod 10 is configured to be fixed to the shelf 14 of the vehicle body structure of the vehicle. As shown in FIGS. 3 and 5, the fixing portion 32 is substantially U-shaped, although the fixing portion can have any suitable configuration, such as being substantially linear as shown in FIGS. 9 and 10.

The first coiled spring portion 34 is disposed between the first end portion 28 and the fixing portion 32, as shown in FIG. 5. The first coiled spring portion 34 includes a plurality of coils 34A. Preferably, the first coiled spring portion 34 has three coils 34A, although the first coiled spring portion 34 can have any suitable number of coils.

The second coiled spring portion 36 is disposed between the second end portion 30 and the fixing portion 32, as shown in FIG. 5. The second coiled spring portion 36 includes a plurality of coils 36A. Preferably, the second coiled spring portion 36 has three coils 36A, although the second coiled spring portion 36 can have any suitable number of coils. The first and second coiled spring portions 34 and 36 are disposed on opposite sides of the fixing portion 32.

The plurality of coils 34A and 36A can have any suitable diameter, such as thirty-five mm. The size of coils 34A and 36A can be sized, or tuned, based on the application. Factors controlling the size of the coils include, but are not limited to, the weight of the closure panel, the desired forces to open and close the closure panel, and the desired opening and closing speeds of the closure panel in various conditions, such as when parked on a flat or sloped surface or in adverse weather conditions, such as wind or rain. The material diameter can also be controlled to meet these noted factors. The diameter of the material can be any suitable diameter, such as eight mm.

As shown in FIGS. 6 and 7, a first end 28A of the first end portion 28 and a second end 30A of the second end portion 30 are offset from centers 34B and 36B of the first and second coiled spring portions 34 and 36, respectively. As shown in FIG. 7, the centers 34B and 36B are preferably aligned. The first and second ends 28A and 30A are preferably aligned. The first end 28A of the first end portion 28 is offset from the center 34B of the first coiled spring portion 34. The second end 30A of the second end portion 30 is offset from the center 36B of the second coiled spring portion 36.

The first and second coiled spring portions 34 and 36 are preferably disposed closer to the fixing portion 32 then to the first and second end portions 28 and 30, respectively, as shown in FIGS. 5 and 6. The first coiled spring portion 34 is disposed closer to the fixing portion 32 then to the first end portion 28. The second coiled spring portion 36 is disposed closer to the fixing portion 32 then to the second end portion 30.

The fixing portion 32 is connected to the shelf 14 of the vehicle body structure to prevent movement of the fixing portion 32 as the closure panel 12 is moved between the closed and open positions. The first and second end portions 28 and 30 are rigidly connected to the first and second hinge arms 22 and 26 of the first and second hinge members 16 and 18, respectively, such that the first and second end portions 28 and 30 move with the hinge arms 22 and 26 when the closure panel 12 moves between the closed and open positions. The first and second coiled spring portions 34 and 36 are energized, or wound, when the closure panel 12 is in the closed position, such that the first and second coiled spring portions unwind when the closure panel 12 is moved to the open position (FIG. 1), thereby facilitating opening the closure panel 12. Moving the closure panel 12 from the open to the closed position (FIG. 2) winds, or energizes, the first and second coiled spring portions 34 and 36. The first and second end portions 28 and 30 being fixed to the first and second hinge arms 22 and 26 and the fixing portion 32 being fixed to the shelf 14 of the vehicle body structure, causes the unwinding and winding of the first and second coiled spring portions 34 and 36 when the closure panel 12 moves between the closed and open positions.

The fixing portion 32 is connected to the shelf 14 of the vehicle body structure in any suitable manner that prevents movement of the fixing portion 32 as the closure panel 12 is moved between the closed and open positions. As shown in FIG. 4, a slot 38 is formed in the shelf 14. The slot 38 extends completely through the shelf 14 from the lower surface 14A to the upper surface 14B. A protrusion 40 extends into the slot 38 to prevent movement of the fixing portion 32 through the slot 38. The slot 38 can be formed in the shelf 14 in any suitable manner, such as by stamping or punching. Alternatively, the protrusion 40 can receive the fixing portion 32, thereby preventing movement of the fixing portion 32 when the closure panel 12 moves between the closed and open positions. The slot 38 can further include a gasket to facilitate reducing noise and vibration associated with opening and closing of the closure panel 12.

Figure 8:
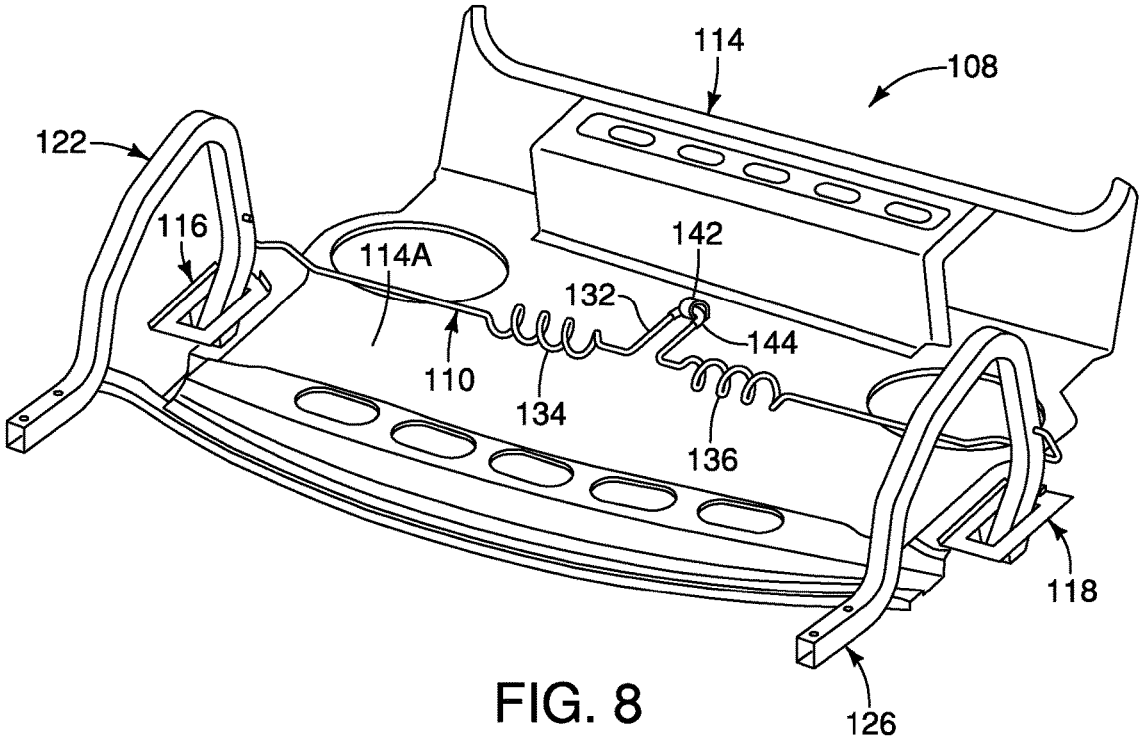
FIG. 8 is a lower perspective view of a torque rod for a closure panel in accordance with another exemplary embodiment of the present invention.

Another exemplary embodiment of the closure panel assembly 108 is shown in FIG. 8. The features of the closure panel assembly 108 of FIG. 8 that are substantially similar to the features of the closure panel assembly 8 of FIGS. 1-7 are provided the same reference numerals as the features of the closure panel assembly 8 except in the 100 series (i.e., 1xx). Moreover, the descriptions of the parts of the closure panel assembly 108 of FIG. 8 that are identical to the closure panel assembly 8 of FIGS. 1-7 are omitted for the sake of brevity.

As shown in FIG. 8, the fixing portion 132 is received by a clip or hook 142 of the shelf 114 of the vehicle body structure to substantially prevent movement of the fixing portion 132 when the closure panel 12 (FIG. 1) is moved between the closed and open positions. The clip 142 can be formed in any suitable manner, such as being fixed to the lower surface 114A of the shelf 114 or being stamped from the shelf 114. A rubber cover 144 can be disposed on the fixing portion 132 to facilitate retention by the clip 142, in addition to reducing noise and vibration associated with movement of the closure panel 12 (FIG. 1) between the closed and open positions.

The connection of the torque rod 110 to the first and second hinge arms 122 and 126 of the first and second hinge members 116 and 118 is substantially the same as the connection of the torque rod 10 to the first and second hinge arms 22 and 26. The first and second coiled spring portions 134 and 136 are formed and operate substantially similarly to the first and second coiled spring portions 34 and 36.

Another exemplary embodiment of the closure panel assembly 208 is shown in FIGS. 9-10. The features of the closure panel assembly 208 of FIGS. 9-10 that are substantially similar to the features of the closure panel assembly 8 of FIGS. 1-7 are provided the same reference numerals as the features of the closure panel assembly 8 except in the 200 series (i.e., 2xx). Moreover, the descriptions of the parts of the closure panel assembly 208 of FIGS. 9-10 that are identical to the closure panel assembly 8 of FIGS. 1-7 are omitted for the sake of brevity.

As shown in FIGS. 9 and 10, the fixing portion 232 extends substantially linearly between the first and second coiled spring portions 234 and 236 of the torque rod. Otherwise, the torque rod 210 is similarly configured as the torque rod 10 illustrated in FIGS. 1-7.

The fixing portion 232 is received by a fixing member 246 fixed to the shelf 214 of the vehicle body structure. The fixing member 246 includes a protrusion 248 extending from the shelf 214 of the vehicle body structure. The fixing portion 232 is received by a recess portion of the protrusion and is fixedly secured thereto by a fastener 250. The fastener 250 further fixes the fixing member 246 to the shelf 214. The protrusion 248 is preferably a hollow member such that the fastener 250 passes axially through the protrusion. The fixing portion 232 is secured between the recessed portion of the protrusion and the head of the fastener 250 to prevent movement of the fixing portion 232 when the closure panel 12 (FIG. 1) moves between the closed and open positions. A rubber cover or coating can be disposed on the fixing portion 232 to facilitate retention by the fixing member 246, in addition to reducing noise and vibration associated with movement of the closure panel 12 (FIG. 1) between the closed and open positions.

The connection of the torque rod 210 to the first and second hinge arms 222 and 226 of the first and second hinge members 216 and 218 is substantially the same as the connection of the torque rod 10 to the first and second hinge arms 22 and 26. The first and second coiled spring portions 234 and 236 are formed and operate substantially similarly to the first and second coiled spring portions 34 and 36.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment (s), the following directional terms "forward", "rearward", "above", "downward", "vertical", "horizontal", "below" and "transverse" as well as any other similar directional terms refer to those directions of a vehicle equipped with the torque rod for a closure panel of a vehicle. Accordingly, these terms, as utilized to describe the present invention should be interpreted relative to a vehicle equipped with the torque rod for a closure panel of a vehicle.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the exemplary embodiments according to the present invention are provided for illustration only, and not for the purpose of limiting the invention as defined by the appended claims and their equivalents.

What is claimed is:

1. A torque rod for a closure panel of a vehicle comprising:

a first end portion configured to be connected to a first hinge member connected to the closure panel;

a second end portion configured to be connected to a second hinge member connected to the closure panel;

a fixing portion configured to be fixed to a vehicle body structure of the vehicle between the first hinge member and the second hinge member;

a first coiled spring portion disposed between the first end portion and the fixing portion; and a second coiled spring portion disposed between the second end portion and the fixing portion;

wherein the torque rod is unitarily formed as a one-piece member.

2. The torque rod according to claim 1, wherein each of the first and second coiled spring portions has three coils.

3. The torque rod according to claim 1, wherein the fixing portion extends substantially linearly between the first and second coiled spring portions.

4. The torque rod according to claim 1, wherein the fixing portion is substantially U-shaped between the first and second coiled spring portions.

5. The torque rod according to claim 1, wherein a first end of the first end portion and a second end of the second end portion are offset from centers of the first and second coiled spring portions, respectively.

6. The torque rod according to claim 1, wherein the first and second coiled spring portions are disposed closer to the fixing portion than to the first and second end portions, respectively.

7. The torque rod according to claim 1, wherein the fixing portion is coated with a protective layer.

8. The torque rod according to claim 1, wherein the torque rod is made of a heat-treated metallic material.

9. A closure panel assembly for a vehicle comprising:

a closure panel movable between a closed position and an opened position;

first and second hinge members movably connecting the closure panel to the vehicle; and a torque rod connected to the first and second hinge members to facilitate moving the closure panel between the closed and opened positions, the torque rod including:

a first end portion connected to the first hinge member;

a second end portion connected to the second hinge member;

a fixing portion engaging a vehicle body structure of the vehicle between the first hinge member and the second hinge member;

a first coiled spring portion disposed between the first end portion and the fixing portion; and a second coiled spring portion disposed between the second end portion and the fixing portion;

wherein the torque rod is unitarily formed as a one-piece member.

10. The closure panel assembly according to claim 9, wherein only one torque rod extends between the first and second hinge members.

11. The closure panel assembly according to claim 9, wherein each of the first and second coiled spring portions has three coils.

12. The closure panel assembly according to claim 9, wherein the fixing portion extends substantially linearly between the first and second coiled spring portions.

13. The closure panel assembly according to claim 12, wherein the fixing portion is received by a protrusion extending from the vehicle body structure.

14. The closure panel assembly according to claim 9, wherein the fixing portion is substantially U-shaped between the first and second coiled spring portions.

15. The closure panel assembly according to claim 14, wherein the fixing portion is received by a slot in the vehicle body structure.

16. The closure panel assembly according to claim 14, wherein the fixing portion is received by a hook connected to the vehicle body structure.

17. The closure panel assembly according to claim 9, wherein a first end of the first end portion and a second end of the second end portion are offset from centers of the first and second coiled spring portions, respectively.

18. The closure panel assembly according to claim 9, wherein the first and second coiled spring portions are disposed closer to the fixing portion than to the first and second end portions, respectively.

* * * * *